US006845764B1

(12) United States Patent
Skinner et al.

(10) Patent No.: US 6,845,764 B1
(45) Date of Patent: Jan. 25, 2005

(54) IGNITION APPARATUS WITH SECONDARY WINDING HAVING REDUCED BREAKDOWN FAILURES

(75) Inventors: Albert Anthony Skinner, Anderson, IN (US); Viorel N. Moga, Anderson, IN (US); Brian Dewayne Lively, Noblesville, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/753,597

(22) Filed: Jan. 8, 2004

(51) Int. Cl.[7] ..... F02P 15/00; H01F 27/28

(52) U.S. Cl. ..... 123/634; 123/635; 336/96; 336/198; 336/223

(58) Field of Search ..... 123/634, 635; 336/179, 96, 198, 222, 223, 224

(56) References Cited

U.S. PATENT DOCUMENTS 5,146,882 A * 9/1992 Brinkman et al. ..... 123/634
5,377,652 A * 1/1995 Noble et al. ..... 123/634
5,406,921 A * 4/1995 Noble et al. ..... 123/479
5,411,006 A * 5/1995 Noble et al. ..... 123/634
6,232,863 B1 5/2001 Skinner et al. ..... 336/96
6,276,348 B1 8/2001 Skinner et al. ..... 123/734
6,679,236 B2 * 1/2004 Skinner et al. ..... 123/634
2002/0014940 A1 2/2002 Konda et al. ..... 336/96
2002/0067233 A1 6/2002 Kondo et al. ..... 336/96

* cited by examiner

*Primary Examiner*—Mahmoud Gimie
*Assistant Examiner*—Arnold Castro
(74) *Attorney, Agent, or Firm*—Jimmy L. Funke

(57) ABSTRACT

An ignition apparatus includes a secondary winding spool having a secondary winding wound thereon. The secondary winding includes a low voltage end and a high voltage end that is configured for connection to a spark plug. The secondary winding at the high voltage end is configured in accordance with a predetermined radial thickness profile taken in the direction from the high voltage end towards the low voltage end. The profile is determined as a function of (1) a reflected voltage associated with the spark gap breakdown of the spark plug and (2) an induced voltage due to magnetic flux coupled through a central core. The profile is determined so as to reduce layer-to-layer voltage levels in the secondary winding near the high voltage end. The profile can be wound or can be molded in the secondary spool itself.

18 Claims, 4 Drawing Sheets

IGNITION APPARATUS WITH SECONDARY WINDING HAVING REDUCED BREAKDOWN FAILURES

TECHNICAL FIELD

The present invention relates generally to ignition coils for developing a spark firing voltage that is applied to one or more spark plugs of an internal combustion engine.

BACKGROUND OF THE INVENTION

Ignition coils are known for use in connection with an internal combustion engine such as an automobile engine, and which include a primary winding, a secondary winding, and a magnetic circuit. The magnetic circuit conventionally may comprise a cylindrical-shaped, central core extending along an axis, located radially inwardly of the primary and secondary windings and magnetically coupled thereto. The components are contained in a case formed of electrical insulating material, with an outer core or shield located outside of the case. One end of the secondary winding is conventionally configured to produce a relatively high voltage when a primary current through the primary winding is interrupted. The high voltage end is coupled to a spark plug, as known, that is arranged to generate a discharge spark responsive to the high voltage. It is further known to provide relatively slender ignition coil configuration that is adapted for mounting directly above the spark plug-commonly referred to as a "pencil" coil.

FIG. 1 illustrates a conventional secondary spool 28 on which a secondary coil 30 is wrapped or wound. Spool 28 includes opposing flanges 28*a* and 28*b* extending outwardly at approximately a 90 degree angle from each end of a main, cylindrical winding section 28*c*. Main winding section 28*c* carries the secondary coil 30. The secondary coil 30 is wound in a progressive fashion at a predetermined angle (after an initial "wedge" 30*a* is formed). The secondary coil is thus formed in a plurality of "layers" 30*b* that slant or are inclined relative to the main winding surface 28*c*. Each "layer" 30*b* has a certain number of turns. For reference, the high voltage end of the secondary coil is designated $30_{HV}$.

One problem in the design of ignition coils, particularly pencil coils, involves a relatively high voltage in the secondary coil near the high voltage end of the secondary spool. Applicants have determined that there are two main contributors to the high voltage: (1) a reflected voltage and (2) a magnetically induced voltage.

FIG. 2 shows the two components resolved, one from another, for an exemplary ignition coil. In an ignition coil, when the spark gap breaks down due to the application of the spark firing voltage thereacross, a relatively high voltage gradient is seen as the end of the coil connected to the spark plug. The magnitude of this voltage gradient is proportional to the current pulse flowing into the ignition coil from the breakdown of the gap (i.e., from ground, across the spark gap, and into the spark voltage end of the secondary coil). This component of the voltage will be referred to as a "reflected" voltage, and is designated as trace 26*a* in FIG. 2. It has been observed by Applicants that increases in the impedance between the ignition coil (i.e., particularly the secondary coil thereof and the spark plug gap tend to decrease the voltage gradient in the ignition coil. Therefore, as ignition coils are moved closer and closer to the spark plug (i.e., a coil-on-plug type versus a separate mount type ignition coil coupled through a spark plug cable, for instance), the level of the voltage gradient increases. The highest gradient is exhibited on the turns of the secondary winding closes to the spark gap. The gradient decreases as it propagates through the secondary winding. In addition, a component of the voltage in the secondary winding is magnetically-induced, with the highest gradient occurring in the middle of the longitudinal length of the secondary winding where the magnetic flux is the most concentrated. The magnetically-induced component is designated as trace 26*b* in FIG. 2.

FIG. 3 shows the superposition of these two influences, designated as trace 26*c*, when the spark plug is fired to produce a spark. Trace 26*c* shows the wire to wire voltage as a function of the distance (i.e., axial distance) from the high voltage (HV) end of the secondary coil. For reference, an open circuit trace 26*d* is also shown, which excludes the influence of the spark current pulse and the associated reflected voltage.

While the secondary winding 30 generally includes a thin film insulation of a type known in the art, such insulation does have its limits. The relatively high voltage between the windings can result in wire-to-wire shorts, causing the ignition coil to perform unsatisfactorily or even fail.

It is known to taper the radial thickness of the secondary winding (and thus the number of turns from the high-voltage (HV) end of the secondary winding towards the low voltage (LV) end of the secondary coil, in an effort to reduce the number of turns per layer, and accordingly the wire to wire voltage. However, this approach results in an unacceptably long taper distance not desirable for commercial products. In addition, it is known to provide a secondary coil spool having ramps on both ends, as seen by reference to U.S. Pat. No. 6,276,348 entitled "IGNITION COIL ASSEMBLY WITH SPOOL HAVING RAMPS AT BOTH ENDS THEREOF" issued to Skinner et al.

Accordingly, there is a need for an improved ignition apparatus that minimizes or eliminates one or more of the problems as set forth above.

SUMMARY OF THE INVENTION

An object of the present invention is to solve one or more of the problems as set forth above. An ignition apparatus according to the present invention overcomes shortcomings of conventional ignition apparatus by including a secondary winding having a predetermined radial thickness profile taken from the high voltage (HV) end towards the opposing low voltage (LV) end, wherein the profile is determined as a function of (1) a reflected voltage associated with a spark event of the spark plug and (2) a magnetically-induced voltage due to magnetic flux coupled through the central core, such profile begin determined so as to reduce layer-to-layer voltage levels in the secondary winding near the HV end. In one embodiment, the maximum wire to wire voltage in the secondary winding is maintained at a level substantially no greater than that existing in the central, main part of the secondary winding, as shown in exemplary fashion by line 26*e* in FIG. 3.

An ignition apparatus according to the present invention comprises a magnetic core having a main axis, a primary winding wound about the magnetic core configured for connection to a voltage source, a secondary spool coaxial with respect to the core, a secondary winding wound in a progressive fashion in a plurality of layers on the secondary spool, the secondary winding having a first end and a second end, the second end being configured for connection to a spark plug, the secondary winding having a predetermined radial thickness profile taken from the second end towards the first end, the profile being determined as a function of (1) a reflected voltage associated with a spark event of the spark plug and (2) an induced voltage due to magnetic flux coupled through the core so as to reduce layer-to-layer voltage levels in the secondary winding proximate the second end.

The invention is operative to limit the wire to wire voltage by varying the winding height and therefore the length of the layers at the high voltage end. In one embodiment, the profile is "stepped" in a manner such that is can be wound using a conventional winding machine. In an alternate embodiment, the profile comprises a curve that can be molded directly into the secondary spool so as to achieve the desired winding height (radial thickness) profile.

Other variations are presented.

BRIEF DESCRIPTION OF THE DRAWINGS

The present invention will now be described by way of example, with reference to the accompanying drawings, in which.

DETAILED DESCRIPTION OF THE PREFERRED EMBODIMENTS

The inventive secondary winding arrangement is suitable for use in an ignition apparatus 10 for use with a spark plug in a spark ignition engine. Before proceeding to a detailed description of the inventive secondary winding arrangement, a general description of the environment in which the present invention may be used will be set forth.

Figure 8:
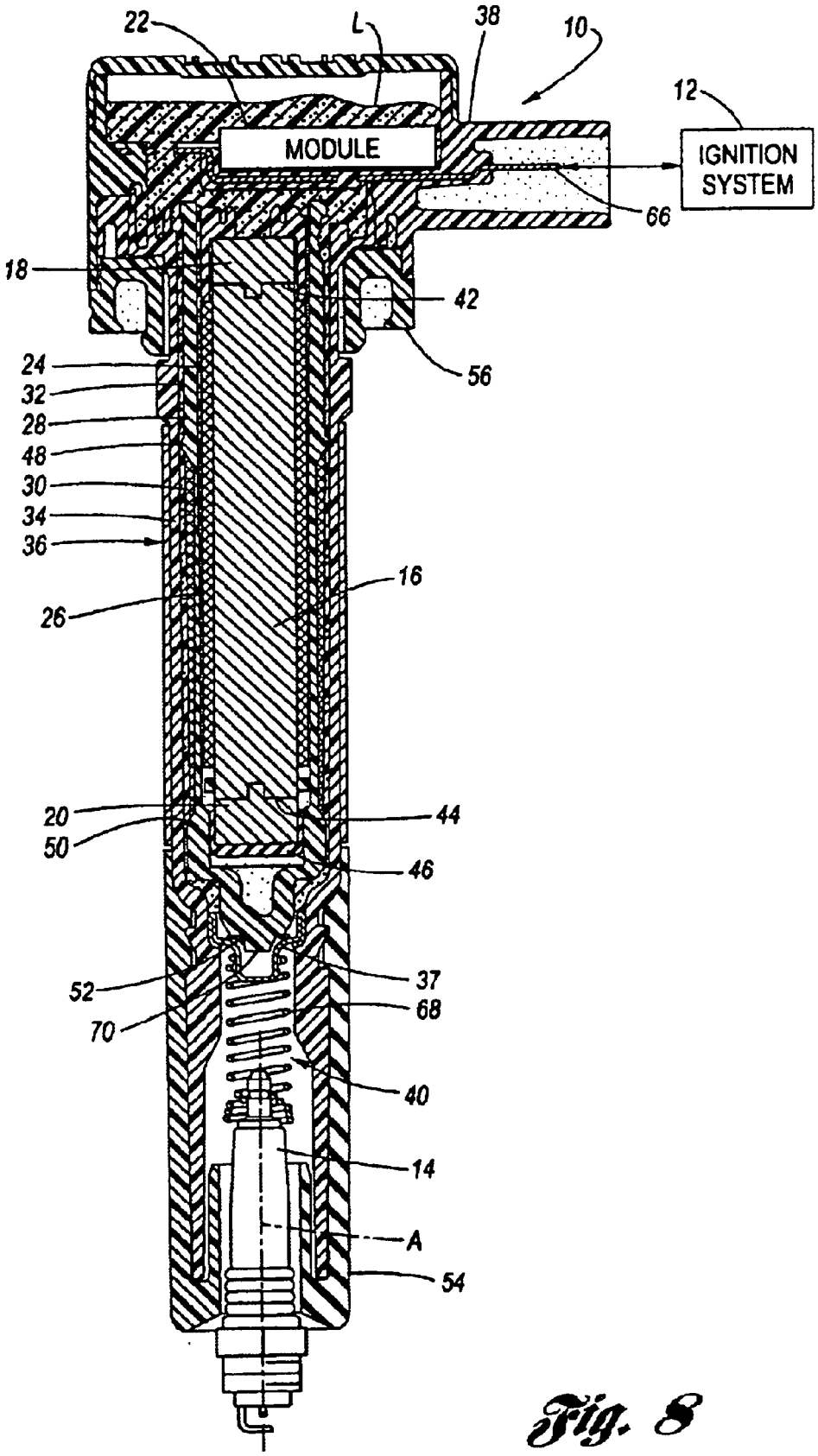
FIG. 8 is a simplified cross-sectional view of an ignition apparatus suitable for using the present invention.

FIG. 8, in this regard, shows that the exemplar ignition apparatus 10 may be coupled to, for example, an ignition system 12, which may contain circuitry for controlling the charging and discharging of ignition apparatus 10. Further, also as is well known, the relatively high voltage produced by ignition apparatus 10 may be provided to a spark plug 14 (shown in phantom-line format) for producing a spark across a spark gap thereof, which may then be employed to initiate combustion in a combustion chamber of an engine. Ignition system 12 and spark plug 14 perform conventional functions well known to those of ordinary skill in the art.

Ignition apparatus 10 is adapted for installation to a conventional internal combustion engine through a spark plug well onto a high-voltage terminal of spark plug 14, which may be retained by a threaded engagement with a spark plug opening into the above-described combustion cylinder. The engine may provide power for locomotion of a vehicle, as known.

FIG. 8 further shows a magnetic core 16 having a main axis "A," an optional first magnet 18, an optional second magnet 20, an electrical module 22, a primary winding 24 configured for connection to a voltage source, a first layer of encapsulant such as an epoxy potting material outside of the primary winding, a secondary winding spool 28 generally coaxial with respect to core 16, a secondary winding 30 wound in a progressive fashion, a second layer 32 of epoxy potting material, a case 34, a shield 36, an electrically conductive cup 37, a low-voltage (LV) connector body 38, and a high-voltage (HV) connector assembly 40. Core 16 includes top end 42 and bottom end 44. FIG. 8 further shows a rubber buffer cup 46, annular portions 48, 50, high voltage terminal 52, boot 54, and seal member 56.

Figure 4:
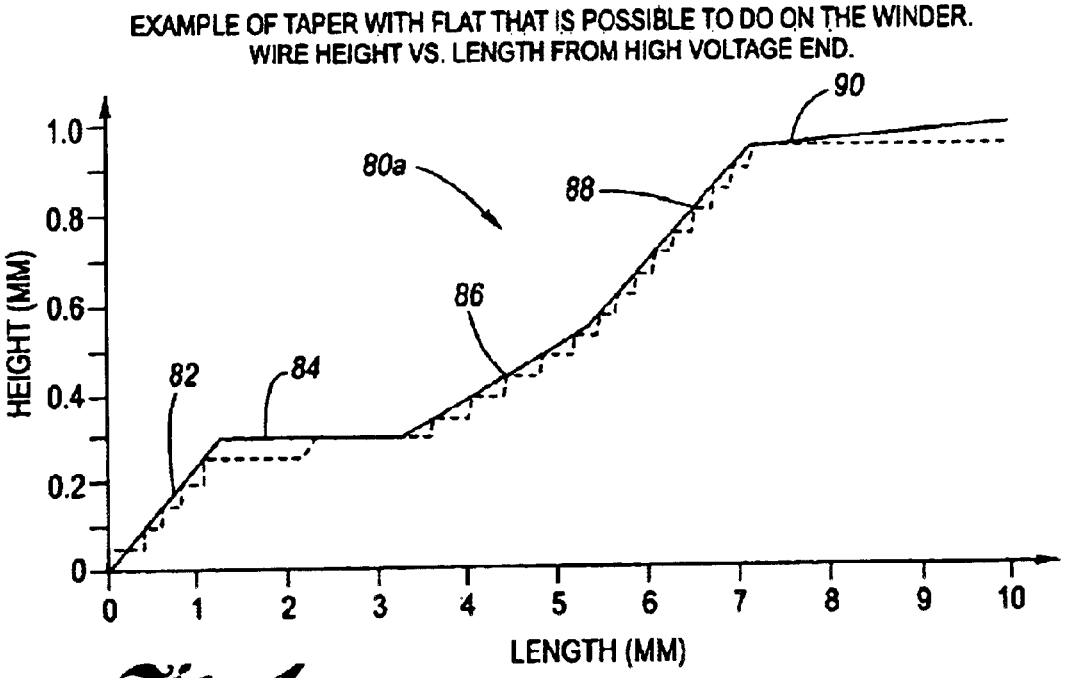
FIG. 4 is a simplified view of a radial thickness profile for a secondary winding in accordance with a first embodiment of the present invention.

With reference now to FIG. 4, the present invention reduces relatively high voltage gradients and thus layer-to-layer voltages in the secondary winding 30 that may occur during operation by specifically controlling the manner in which the secondary winding is wound near the HV end. In this regard, FIG. 4 shows a first radial thickness profile 80*a*, taken with reference to the HV end of the secondary winding. The profile 80*a* is determined taking into account (1) a reflected voltage associated with the break down of the spark gap at the beginning of the spark event and (2) a magnetically-induced voltage due to the magnetic flux coupled through the core, determined so as to reduce a layer to layer (and thus axially adjacent wire to wire) voltage levels in the secondary winding, particularly near or proximate the HV end.

The present invention limits such wire to wire voltage by varying the winding height (radial height taken with respect to the main winding surface) and therefore the length of the layers at the HV end of the ignition apparatus. Specifically, this is done by determining the wire to wire voltage versus the turns from the HV end of the secondary winding inward and then configuring the windings to minimize the "layer to layer" gradient. In the embodiment shown in FIG. 4, the predetermined radial thickness profile 80*a* is implemented so as to be capable of being manufactured using a conventional winder (by varying the winding angle for each "step"). The profile 80*a* includes a first tapered portion 82, a flat portion 84, a second tapered portion 86, and a third tapered portion 88. A main tapered portion 90 is shown, and this is the secondary winding 30 on the main winding surface of the secondary winding spool 28. The taper to portion 90 is known, and comprises a very slight taper from the low voltage end (where the secondary winding is the highest thickest) towards the high voltage end (where the secondary winding is thinner) so as to allow a corresponding increase in the thickness of the layer 32 of epoxy resin that is radially outwardly (see FIG. 8).

The overall resulting stepped taper approach (profile 80*a*) shown in FIG. 4 reduces the voltage much more quickly than a constant taper (i.e., less axial distance), while not requiring as much winding area. In the embodiment of FIG. 4, the profile 80*a* is realized as a taper with a flat, and then resuming the taper until the wire to wire voltage calculated is, in one embodiment, not greater than the magnetically induced voltage in the part of the secondary winding near the center of the central core/secondary winding spool.

As shown in FIG. 4, the first tapered portion 82 has a first slope and the second tapered portion has a second slope that is less than the first slope. The flat portion 84 is "substantially" flat, although is may include a small taper. Third tapered portion 88 has a third slope that is greater than the second slope of second tapered portion 86, although it may not be as great as the first slope of the first tapered portion 82, as shown in exemplary fashion. A process for calculating the foregoing may involve the following steps.

First, acquire empirical data by measuring the voltage across an increasing number of turns (e.g., at 10 turns, at 20 turns, at 30 turns, etc.) at the time of gap ionization, and record this information.

Second, determine the voltage versus turns (N) relationship using equation (1)

$$\int_0^n (V/\text{Turn})\,dn \tag{1}$$

Equation (1) defines the curve defined by the empirical data taken above; accordingly, one would set the empirical data curve equal to equation 91). Then, by fitting the measured data and taking the derivative of the curve (e.g., the integral drops out of equation (1) when taking the derivative), one can obtain V/Turn (vs) N. The V/Turn (vs) N relationship only represents the voltage induced by the current pulse from the gap breakdown-herein the "reflected voltage."

Figure 1:
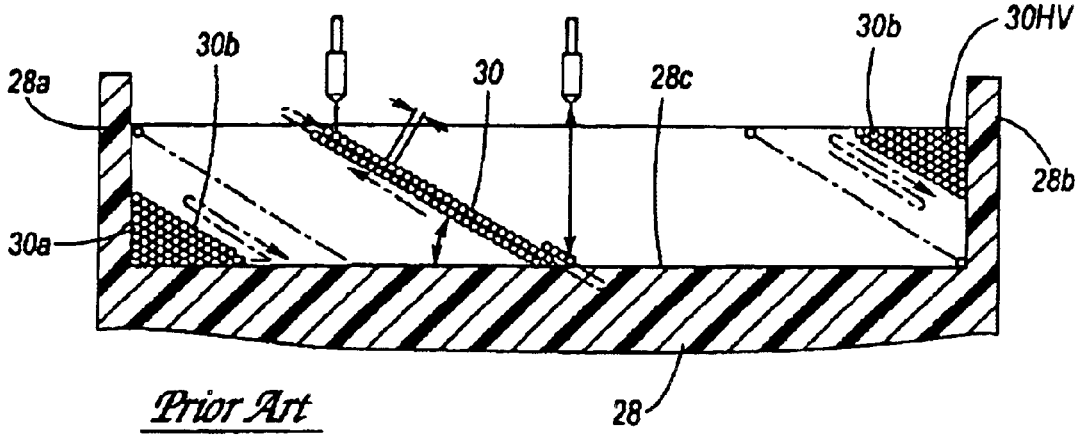
Prior Art Fig. 1
FIG. 1 is a simplified cross-sectional view of a conventional secondary spool with a secondary winding wound thereon.
Figure 2:
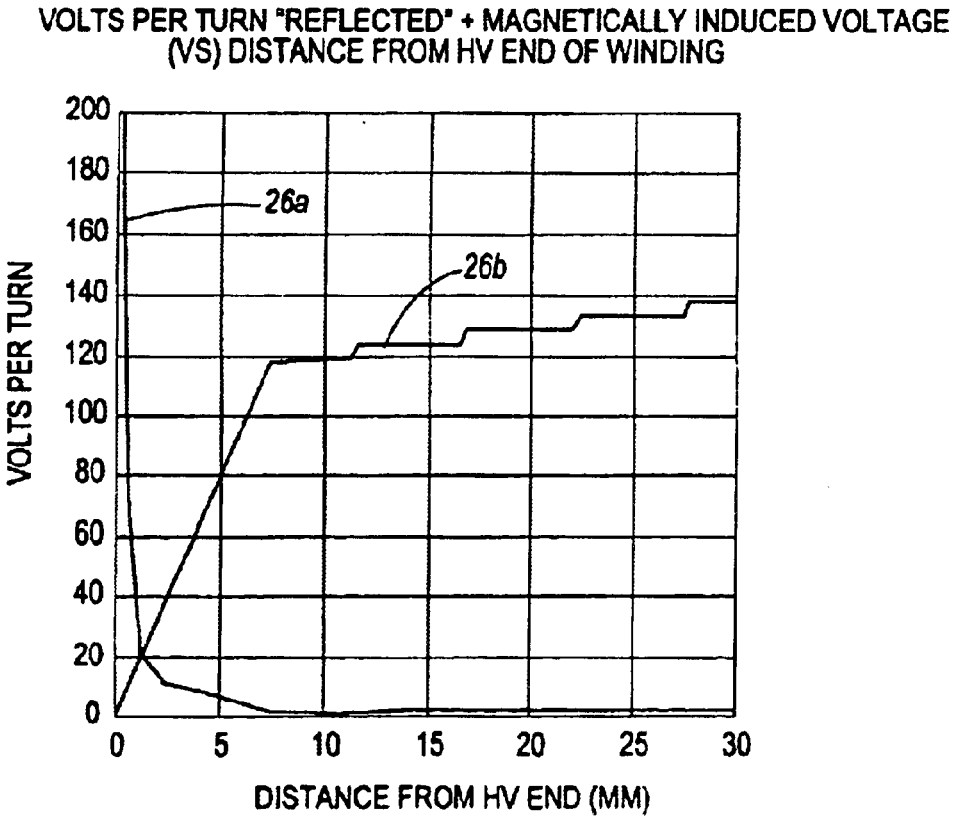
FIG. 2 is a diagram showing a reflected voltage and a magnetically-induced voltage observed in a secondary winding during the spark.
Figure 3:
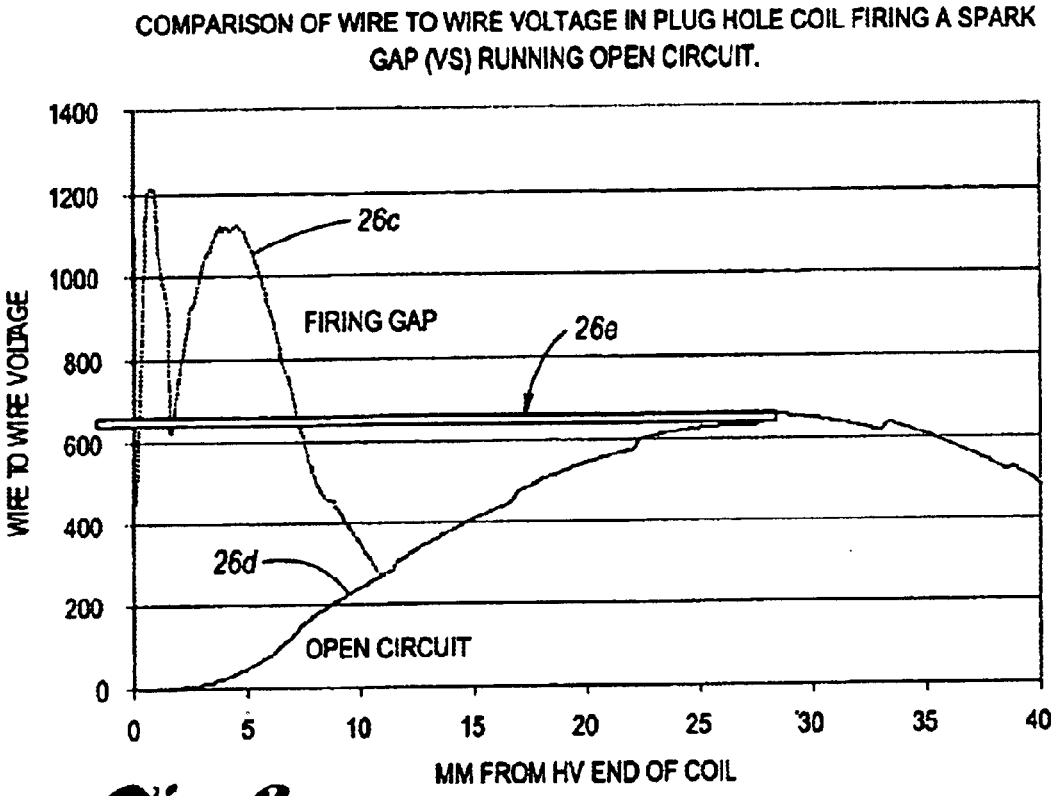
FIG. 3 is a diagram showing the composite effect of the individual voltage traces shown in FIG. 2.

As shown in FIG. 2, for example, the measured data indicate that by 3000 turns, in one embodiment, the reflected voltage component decays to close to zero volts.

To obtain the composite, total Volts/Turn (and thus wire-to-wire voltage between any adjacent layers), the magnetically induced voltage must also be calculated.

First, start with the standard equation (2) of the relationship between induced voltage and magnetic flux.

$$\frac{V}{\text{Turn}} = \frac{d\phi}{dt} \tag{2}$$

If dt is assumed substantially constant through the secondary winding, then equation (3) holds:

$$\frac{V}{\text{Turn}} \propto d\phi \tag{3}$$

The magnetic Vector Potential, A (Amp Turns), may be assumed to be about 0 Amp Turns when no magnets are used, and may be about A=5e−4 wb/m at 0 Amp Turns with magnets. Accordingly, equation (4) may be used:

(4) $\Delta\phi \propto \Delta A$ between a maximum Amp Turns to Zero Amp Turns.

Thus, equation (5) may be obtained:

$$\frac{V}{\text{Turn}} \cong K\Delta A \tag{5}$$

Where $\Delta A$ may be determined from FEA analysis, and

K may be determined for an exemplary total output of 30 kV (at HV end of winding 28).

With induced V/Turn and measured reflected V/Turn each determined, the entire voltage profile can be determined.

Based on the foregoing equations and calculation methodology, the profile 80*a* has been developed to reduce peak voltages in the secondary winding at the high voltage end (ie., the end configured for connection, through a suitable connector, to a spark plug). For example, the composite maximum at any point can be set to be no greater than that in the central part of the core. Iterative analysis can then allow one to determine the maximum number of turns as you move away from the HV end so that the maximum voltage can be controlled. The number of turns drives the height (or radial thickness).

Figure 5:
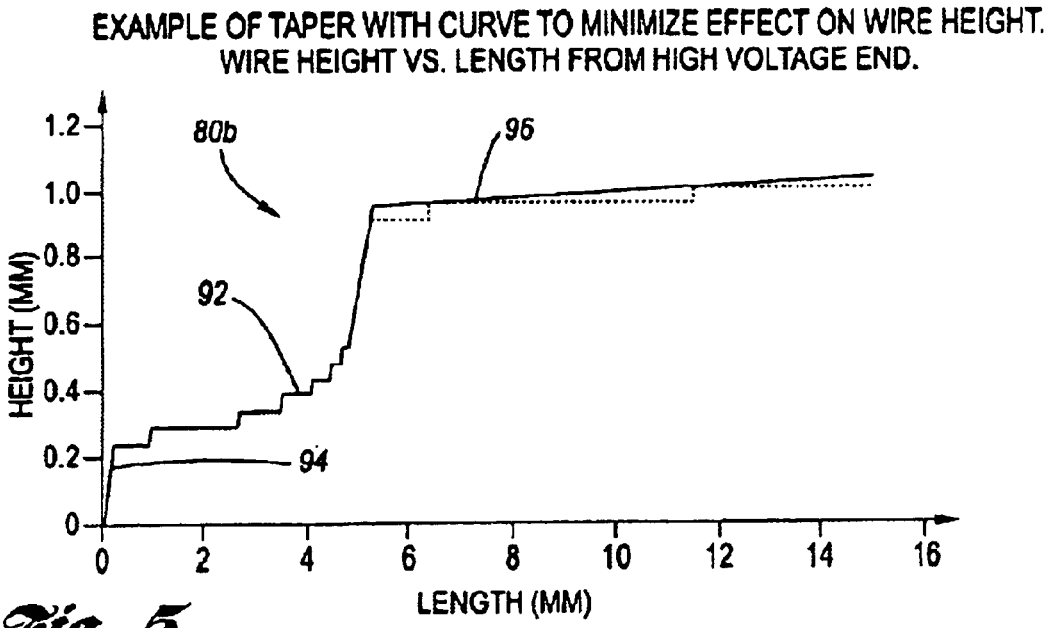
FIG. 5 is a simplified view of a radial thickness profile for a secondary winding in accordance with a second embodiment of the present invention.

FIG. 5 shows a second predetermined radial thickness profile 80*b* corresponding to a second embodiment according to the present invention. Profile 80*b* comprises a curve portion 92 adjacent to a tapered portion 94. Tapered portion 96 is similar to tapered portion 90 in FIG. 4 (i.e., it represents the secondary winding on the main winding surface of the secondary spool). The profile 80*b* is configured to minimize the transition to the main winding portion (item 90 or item 96, as the case may be). However, there are practical challenges in implementing profile 80*b* using known winding machine technologies. Accordingly, either or both of the first and second embodiments may, alternatively, be formed by molding the complement of the profile into the plastic secondary spool.

Figure 6:
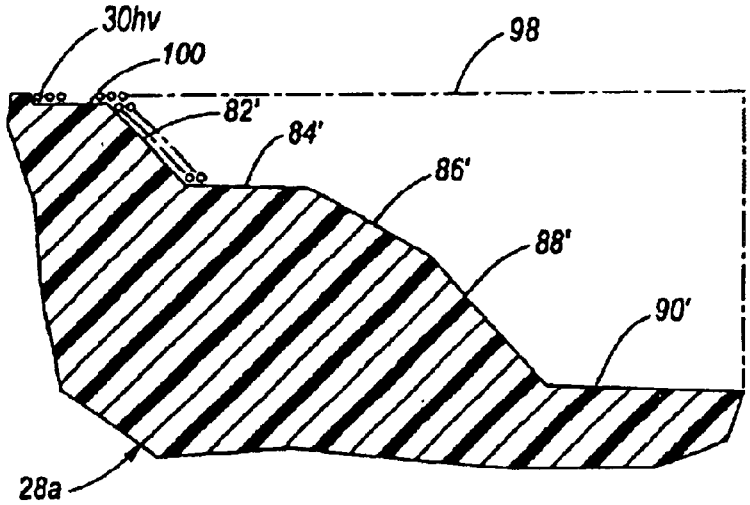
FIG. 6 is a simplified cross-sectional view of a secondary spool ramp having a stepped taper configured to obtain the radial thickness profile of the first embodiment of FIG. 4.

FIG. 6 shows the first embodiment of FIG. 4 as molded into the plastic spool 28*a*. Note that there are several portions corresponding to those shown in FIG. 4, namely, first tapered portion designated 82', flat portion designated 84', second tapered portion designated 86' and third tapered portion designated 88'. Portion 90' represents the main winding surface referred to above, which, as also previously mentioned, includes a small tapered such that the radial thickness or height gradually decreases working from the low voltage end to the high voltage end 30HV of the secondary winding. In a still further embodiment, the first few turns (e.g., 20 to 100) may still be subjected to a voltage level that is undesirably high (i.e., too high of a wire to wire voltage). In this still further embodiment, a further flat portion 100 adjacent the first tapered portion 82' may be provided to receive the high voltage end of secondary winding 30 in a single layer within the same bay at the end of the ramp. This single layer ending of the secondary winding may be implemented either in the winding or implemented in the plastic spool, as shown in FIG. 6. Also observe that in the embodiment shown, the secondary winding 30 is wound to substantially the same level 98—it is the profile molded into the plastic that determines the variations in the radial thickness or height of the secondary winding.

Figure 7:
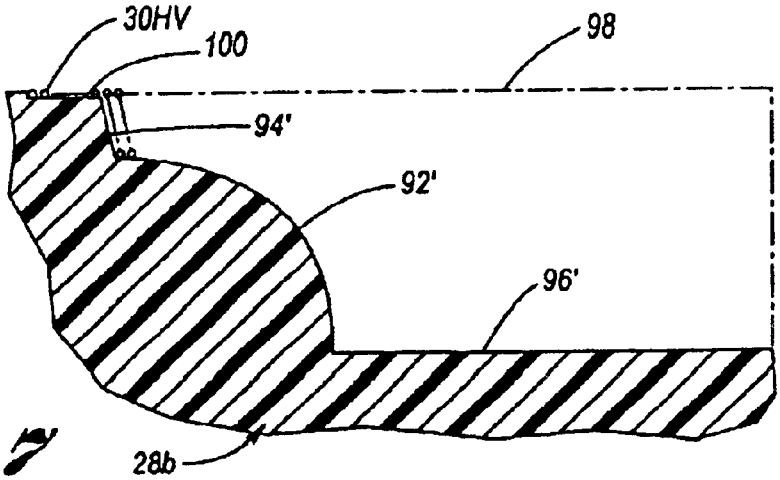
FIG. 7 is a simplified cross-sectional view of a secondary spool ramp having a curved surface configured to obtain the radial thickness profile of the second embodiment of FIG. 5.

FIG. 7 shown the second embodiment of FIG. 5 as molded into the plastic spool 28*b*. Note that there are multiple portions corresponding to those shown in FIG. 5, namely, the curve portion designated 92', the tapered portion designated 94', and the main winding surface designated 96'. Single layer winding portion 100 is also shown in FIG. 7, and may be provided, as described above, as an alternate embodiment. Also, as in FIG. 6, FIG. 7 shows that the secondary winding is wound to the same level 98—it is the profile molded into the plastic spool that varies the radial thickness or height of the secondary winding.

Referring again to FIG. 8, further details concerning ignition apparatus 10 will now be set forth configured to enable one to practice the present invention. It should be understood that portions of the following are exemplary only and not limiting in nature. Many other configurations are known to those of ordinary skill in the art and are consistent with the teachings of the present invention. Core 16 may be elongated, having a main, longitudinal axis "A" associated therewith. Core 16 includes an upper, first end 42, and a lower, second end 44. Core 16 may be a conventional core known to those of ordinary skill in the art. As illustrated, core 16, in the preferred embodiment, takes a generally cylindrical shape (which is a generally circular shape in radial cross-section), and may comprise compression molded insulated iron particles or laminated steel plates, both as known.

Magnets 18 and 20 may be included in ignition apparatus 10 as part of the magnetic circuit, and provide a magnetic bias for improved performance. The construction of magnets such as magnets 18 and 20, as well as their use and effect on performance, is well understood by those of ordinary skill in the art. It should be understood that magnets 18 and 20 are optional in ignition apparatus 10, and may be omitted, albeit with a reduced level of performance, which may be acceptable, depending on performance requirements. A rubber buffer cup 46 may also be included.

Primary winding 24 may be wound directly onto core 16 in a manner known in the art. Primary winding 24 includes first and second ends and is configured to carry a primary current IP for charging apparatus 10 upon control of ignition system 12. Winding 24 may be implemented using known approaches and conventional materials. Although not shown, primary winding 24 may be wound on a primary winding spool (not shown) in certain circumstances (e.g., when steel laminations are used).

First insulating layer (between primary winding and inside diameter of secondary spool) and second insulating layer 32 comprise an encapsulant suitable for providing electrical insulation within ignition apparatus 10. In a preferred embodiment, the encapsulant comprises epoxy potting material. The epoxy potting material introduced in such layers may be introduced into annular potting channels defined (i) between primary winding 24 and secondary winding spool 28, and (ii) between secondary winding 30 and case 34. The potting channels are filled with potting material, in the illustrated embodiment, up to approximately the level designated "L" in FIG. 8. A variety of other thicknesses are possible depending on flow characteristics and insulating characteristics of the encapsulant and the design of the coil 10. The potting material also provides protection from environmental factors which may be encountered during the service life of ignition apparatus 10. There is a number of suitable epoxy potting materials well known to those of ordinary skill in the art.

Secondary winding spool 28 is configured to receive and retain secondary winding 30. In addition to the features described above, spool 28 is further characterized as follows. Spool 28 is disposed adjacent to and radially outwardly of the central components comprising core 16, primary winding 24, and the epoxy potting layer between the primary winding and the inside diameter (ID) of the secondary spool Preferably, the spool is in coaxial relationship with these components. In the illustrated embodiment, spool 28 is configured to receive one continuous secondary winding (e.g., progressive winding) on an outer surface thereof, as is known.

The depth of the secondary winding in the illustrated embodiment may decrease from the top of spool 28 (i.e., near the upper end 42 of core 16) to the other end of spool 28 (i.e., near the lower end 44) by way of a progressive gradual flare of the spool body. The result of the flare or taper is to increase the radial distance (i.e., taken with respect to axis "A") between primary winding 24 and secondary winding 30, progressively, from the top to the bottom. As is known in the art, the voltage gradient in the axial direction, which increases toward the spark plug end (i.e., high voltage end) of the secondary winding, may require increased dielectric insulation between the secondary and primary windings, and, may be provided for by way of the progressively increased separation between the secondary and primary windings. Other aspects of spool 28 and/or winding 30 in accordance with the invention are as set forth above.

Spool 28 is formed generally of electrical insulating material having properties suitable for use in a relatively high temperature environment. For example, spool 28 may comprise plastic material such as PPO/PS (e.g., NORYL available from General Electric) or polybutylene terephthalate (PBT) thermoplastic polyester. It should be understood that there are a variety of alternative materials that may be used for spool 28 known to those of ordinary skill in the ignition art, the foregoing being exemplary only and not limiting in nature.

Spool 28 may further include a first and second annular feature 48 and 50 formed at axially opposite ends thereof. Features 48 and 50 may be configured so as to engage an inner surface of case 34 to locate, align, and center the spool 28 in the cavity of case 34.

In one embodiment, spool 28 includes an electrically conductive (i.e., metal) high-voltage (HV) terminal 52 disposed therein configured to engage cup 37, which in turn is electrically connected to the HV connector assembly 40. The body of spool 28 at a lower end thereof is configured so as to be press-fit into the interior of cup 37 (i.e., the spool gate portion).

FIG. 8 also shows secondary winding 30 in cross-section. Secondary winding 30, as described above, is wound on spool 28, and includes a low voltage end and a high voltage end. The low voltage end may be connected to ground by way of a ground connection through LV connector body 38 in a manner known to those of ordinary skill in the art. The high voltage end is connected to HV terminal 52.

Case 34 includes an inner, generally enlarged cylindrical surface, an outer surface, a first annular shoulder, a flange, an upper through-bore, and a lower through bore.

The inner surface of case 34 is configured in size to receive and retain spool 28 which contains the core 16 and primary winding 24. The inner surface of case 34 may be slightly spaced from spool 28, particularly the annular spacing features 48, 50 thereof (as shown), or may engage the spacing features 48, 50.

Lower through bore 64 is defined by an inner surface thereof configured in size and shape (i.e., generally cylindrical) to provide a press fit with an outer surface of cup 37 at a lowermost portion thereof as described above. When the lowermost body portion of spool 28 is inserted in the lower bore containing cup 37, HV terminal 52 engages an inner surface of cup 37 (also via a press fit).

Case 34 is formed of electrical insulating material, and may comprise conventional materials known to those of ordinary skill in the art (e.g., the PBT thermoplastic polyester material referred to above).

Shield 36 is generally annular in shape and is disposed radially outwardly of case 34, and, preferably, engages an outer surface of case 34. The shield 36 preferably comprises electrically conductive material, and, more preferably metal, such as silicon steel or other adequate magnetic material. Shield 36 provides not only a protective barrier for ignition apparatus 10 generally, but, further, provides a magnetic path for the magnetic circuit portion of ignition apparatus 10. Shield 36 may nominally be about 0.50 mm thick, in one embodiment. Shield 36 may be grounded by way of an internal grounding strap, finger or the like (not shown) well know to those of ordinary skill in the art. Shield 36 may comprise multiple, individual sheets 36, as shown.

Low voltage connector body 38 is configured to, among other things, electrically connect the first and second ends of primary winding 24 to an energization source. Connector body 38 is generally formed of electrical insulating material, but also includes a plurality of electrically conductive output terminals 66 (e.g., pins for ground, primary winding leads, etc.). Terminals 66 are coupled electrically, internally through connector body 38, in a manner known to those of ordinary skill in the art, and are thereafter connected to various parts of apparatus 10, also in a manner generally know to those of ordinary skill in the art.

HV connector assembly 40 may include a spring contact 68 or the like, which is electrically coupled to cup 37. Contact spring 68 is in turn configured to engage a high-voltage connector terminal of spark plug 14. This arrangement for coupling the high voltage developed by secondary winding 30 to plug 14 is exemplary only; a number of alternative connector arrangements, particularly spring-biased arrangements, are known in the art.

What is claimed is:

1. An ignition apparatus for a spark ignition engine comprising:

a magnetic core having a main axis;

a primary winding wound about said magnetic core configured for connection to a voltage source;

a secondary spool coaxial with respect to said core;

a secondary winding wound in a progressive fashion in a plurality of layers on said secondary spool, said secondary winding having a first end and a second end, said second end being configured for connection to a spark plug, said secondary winding having a predetermined radial thickness profile taken from said second end towards said first end, said profile being determined as a function of (1) a reflected voltage associated with a spark event of the spark plug and (2) an induced voltage due to magnetic flux coupled through said core so as to reduce layer-to-layer voltage levels in said secondary winding proximate said second end.

2. The ignition apparatus of claim 1 wherein said secondary spool includes a main winding surface on which a portion of said secondary winding is wound, said predetermined radial thickness profile being further determined so as to reduce layer-to-layer voltage levels proximate said second end to a level substantially 5 no greater than layer-to-layer voltage levels in said secondary winding wound on said main winding surface.

3. The ignition apparatus of claim 1 wherein said predetermined radial thickness profile comprises a curve.

4. The ignition apparatus of claim 1 wherein said predetermined radial thickness profile comprises a first tapered portion, a flat portion, and a second tapered portion.

5. The ignition apparatus of claim 4 wherein said first tapered portion, said flat portion, and said second tapered portion are adjacent one another, said first tapered portion being nearer to said second end than said second tapered portion.

6. The ignition apparatus of claim 5 wherein said first tapered portion has a first slope, said second tapered portion has a second slope less than said first slope.

7. The ignition apparatus of claim 6 wherein said profile further includes a third tapered portion adjacent said second tapered portion, said third tapered portion having a third slope that is greater than said second slope.

8. The ignition apparatus of claim 5 wherein said profile includes a single layer having a predetermined number of turns adjacent to said first tapered layer, said single layer being substantially flat and disposed nearer to said second end of said secondary winding than said first tapered portion.

9. The ignition apparatus of claim 1 wherein secondary spool includes a winding portion having a spool end profile that is complementary that of said radial thickness profile such that an outside diameter of said secondary winding is substantially constant.

10. An ignition apparatus for a spark ignition engine comprising:

a magnetic central core having a main axis;

a primary winding wound about said magnetic core configured for connection to a voltage source;

a secondary spool coaxial with respect to said core;

a secondary winding wound in a progressive fashion in a plurality of layers on said secondary spool, said secondary winding having a first end and a second end, said second end being configured for connection to a spark plug, said secondary winding having a predetermined radial thickness profile taken from said second end towards said first end, said profile being determined as a function of (1) a reflected voltage associated with a spark event of the spark plug and (2) an induced voltage due to magnetic flux coupled through said core so as to reduce layer-to-layer voltage levels in said secondary winding proximate said second end; and a magnetic outer core surrounding said central core, said primary winding and said secondary winding.

11. The ignition apparatus of claim 10 wherein said secondary spool includes a main winding surface on which a portion of said secondary winding is wound, said predetermined radial thickness profile being further determined so as to reduce layer-to-layer voltage levels proximate said second end to a level substantially no greater than layer-to-layer voltage levels in said secondary winding wound on said main winding surface.

12. The ignition apparatus of claim 10 wherein said predetermined radial thickness profile comprises a curve.

13. The ignition apparatus of claim 10 wherein said predetermined radial thickness profile comprises a first tapered portion, a flat portion, and a second tapered portion.

14. The ignition apparatus of claim 13 wherein said first tapered portion, said flat portion, and said second tapered portion are adjacent one another, said first tapered portion being nearer to said second end than said second tapered portion.

15. The ignition apparatus of claim 14 wherein said first tapered portion has a first slope, said second tapered portion has a second slope less than said first slope.

16. The ignition apparatus of claim 15 wherein said profile further includes a third tapered portion adjacent said second tapered portion, said third tapered portion having a third slope that is greater than said second slope.

17. The ignition apparatus of claim 14 wherein said profile includes a single layer having a predetermined number of turns adjacent to said first tapered layer, said single layer being substantially flat and disposed nearer to said second end of said secondary winding than said first tapered portion.

18. The ignition apparatus of claim 10 wherein secondary spool includes a winding portion having a spool end profile that is complementary that of said radial thickness profile such that an outside diameter of said secondary winding is substantially constant.

* * * * *